United States Patent [19]

Makansi et al.

[11] Patent Number: 4,822,037

[45] Date of Patent: Apr. 18, 1989

[54] RESISTANCE CONTROL SYSTEM FOR MUSCLE THERAPY/EXERCISE/TRAINING AND STRENGTH MEASUREMENT

[75] Inventors: Tarek Makansi, Los Gatos; Robert E. Hora, San Ramon, both of Calif.

[73] Assignee: Digital Kinetics Corporation, Danville, Calif.

[21] Appl. No.: 58,895

[22] Filed: Jun. 5, 1987

[51] Int. Cl.[4] ..... A63B 23/00

[52] U.S. Cl. ..... 272/129

[58] Field of Search ..... 272/129

[56] References Cited

U.S. PATENT DOCUMENTS

| | | | |
|---|---|---|---|
| 3,869,121 | 3/1975 | Flavell | 272/129 |
| 4,620,703 | 11/1986 | Greenhut | 272/129 |
| 4,628,910 | 12/1986 | Krukowski | 272/129 |
| 4,730,829 | 3/1988 | Carlson | 272/129 |

*Primary Examiner*—Leo P. Picard

*Attorney, Agent, or Firm*—Allston L. Jones

[57] ABSTRACT

Motion of a user exercising acts against an electric brake. The current flowing in the coil of the brake is controlled by an electronic circuit in accordance with a specified function from a computer or another electronic circuit.

27 Claims, 6 Drawing Sheets

RESISTANCE CONTROL SYSTEM FOR MUSCLE THERAPY/EXERCISE/TRAINING AND STRENGTH MEASUREMENT

BACKGROUND OF THE INVENTION

The present invention relates to a machine which provides a resisting force for use in electronic- or computer-controlled equipment for exercise, training, or physical therapy.

Exercise has historically fallen into two categories: aerobic exercise and resistance exercise. Aerobic exercise is characterized by low resistance to the user's motion, but maintained at high speed for an extended period of time resulting in increased heartbeat and breathing rates. Resistance exercise, however, involves a greater resistance for shorter periods of time to intentionally break down and regenerate muscle tissue and lead to increased muscle bulk and strength. Equipment for both aerobic and resistance exercise have recently progressed into electronically enhanced versions.

The aerobic machines have progressed more rapidly into electronically enhanced versions due to two characteristics of this type of exercise: (1) relatively low resistance, and (2) intermittently or slowly varying resistance force levels over time.

This progression is evidenced by the recent introduction of electronically controlled rowing machines by Precor and AMF, and by the electronic stationary bicycles available from Bally, and by the computer-monitored moving staircase by Stainmaster.

The progress of electronically enhanced resistance equipment has progressed into mechanical machines of axles, pulleys, chains, wire rope, sprockets, and handlebars which could transmit the user's motion into the raising and lowering of stacks of weights. These machines made resistance exercise more convenient and could isolate individual muscle groups more effectively.

A mechanical enhancement of resistance equipment was patented by Jones [U.S. Pat. No. 3,858,873]. This invention added sophistication to weight-based machines by adding the capability of varying the resistance level as a function of the position of the user's moving member. This advancement is especially important where gravitational forces alone do not result in constant resistance throughout the exercise stroke, as in rotary exercises performed with free weights.

Later, electronic control of resistance began to enhance resistance exercise. Flavell (1973) discloses in U.S. Pat. No. 3,869,121 a machine that provides braking resistance in one direction through the use of an electric brake, and motion in the other direction using, for example, an electric motor or spring. Flavell later introduced [U.S. Pat. No. 4,184,678] an electromechanical machine that could regulate the user's motion against a desired, predetermined, force vs. speed characteristic, thereby creating a speed-programmable device. Still another of Flavell's U.S. patents, U.S. Pat. No. 4,261,562, advanced the speed-programmable device to include a motor with a wound stator interacting with rotating magnets to provide the resistance force. This resistance force is generated by the energy dissipated in an electrical loading of the stator windings. A similar exercise device was disclosed by Dorfman in U.S. Pat. No. 4,602,373 is which two electrically shorted commutator brushes are positioned against a rotating coil to regulate the resistance torque.

Bruder [U.S. Pat. No. 4,518,163] produced a machine that provided braking resistance levels as a stepwise function of the position of the user's moving member. With electronic control, the possibility of having random resistance levels, not predictable by the user, was reduced to practice by Sweeny in U.S. Pat. No. 4,358,105. Having resistance levels increase or decrease adaptively as a function of the user's performance was conceived by Jungerwith and such a machine was disclosed in his U.S. Pat. No. 4,323,237.

Electronic resistance also enables sophisticated monitoring of the user's performance during the exercise process. Barron patented a device [U.S. Pat. No. 3,984,666] which could accumulate and display calories expended during exercise using a resistance mechanism based on an alternator. Relyea [U.S. Pat. No. 4,408,613] extended this concept by having an audio-visual system instruct the user while controlling resistance through an electric brake. A motor-clutch combination was proposed as a resistance mechanism by Fulks in U.S. Pat. No. 4,569,518. The variable clutch selectively applies torque from the motor to the user during exercise.

The demand for the user himself or his trainer, coach, or therapist to program individualized resistance profiles as a function of position was partially fulfilled by Ariel, as revealed in his U.S. Pat. No. 4,354,676. The programmability of a resistance machine represented an advancement in flexibility of resistance exercise. This system could also accumulate and display characteristics and statistics of the user's exercise. A later U.S. Pat. No. 4,544,154 by Ariel employed feedback control circuitry, leaving the computer more computational time for monitoring and graphical display. This patent specified a hydraulic cylinder as the resistance device.

Although the Ariel machine is programmable, it does assume the availability of a resistance mechanism that can respond to electrical signals. Much less work is apparent in the provision of a generalized, electronic resistance device having the characteristics needed to (1) be adaptable to a broad range of exercise machines, even retrofitted to existing weight-based systems, and (2) be capable of interfacing to electronic or computer based control in a variety of exercise modes. To fulfill need (1) the resistance device must be capable of providing potentially high levels of resistance. To fulfill need (2) the electronics and mechanical system must have a short response time (i.e. the time between a force resistance level is commanded by a computer or electronic circuit and the time that the resistance force is actually available).

Fulfilling both of these needs simultaneously represents an engineering challenge due to electrical and mechanical inertia forces typically present in electric brakes or other force-generating devices. Mechanical inertia exists in the form of static and dynamic friction and rotational mass of the gear trains. Electrical inertia exists in the inductance of coils needed to generate electromagnetic forces. Although the Ariel patent does suggest using computer control to remove these anamolous forces, it does not discuss the fast response required of the resisting device.

The response-time problem was addressed in European patent application No. 0060302, by applicant Mitsubishi Kinzoku Kabushiki Kaisha, entitled "Muscle Training and Measuring Machine", filed on May 5, 1981. A solution to the problem, presented in the patent application, was the use of a hydraulic servo amplifier. The resulting invention was a hydraulic-based resistance mechanism capable of responding quickly to electrical signals. This patent application also revealed the necessity of quick response for most forms of sophisticated resistance exercise including isokinetic and isometric. This patent application also faulted motor- and brake-based resistance mechanisms for having resistance characteristics that are difficult to control, mentioning specifically friction and rotary mass of the rotor and gears. Although this invention claimed to solve the inertia problems for hydraulic-based resistance system, no known solution for brake-based systems is available. Brakes have advantages over hydraulics and motor based systems. Hydraulic cylinders contain a fluid that can leak and needs to be replaced periodically. Motors have a greater change of violating the user's safety than brakes. Motors create motion, but brakes only resist motion created by the user. If the user becomes weakened during exercise, a motor will continue to burden the user, possibly to the point of injury. Free weights as well as motors have this safety disadvantage relative to brakes.

Hence, the need does exist for a fast responding brake-based resistance mechanism, which is capable of high resistance forces and is adaptable to all modes of exercise in a safe manner. These needs are satisfied by the invention disclosed herein. This invention difers from the Flavell machine disclosed in U.S. Pat. No. 4,261,562 (previously mentioned) in that a brake is used to control forces directly rather than by varying the load on an electric motor acting as a generator. Load variation only permits varying the constant of proportionality between force and speed, whereas an electric brake can generate a force independent of, or arbitrarily dependent on, speed. This invention teaches a fast responding control system for a brake-based machine.

Three types of electric brakes are of common availability. The first type is the friction brake, in which an electric current flows through a coil of wire in the stationary portion (stator) producing a magnetic field which pulls the moving portion (rotor) in contact with the stator. The force of contact resists the motion of the rotor through friction properties of the material in contact.

The second type of electric brake is the hysteresis brake. In a hysteresis brake, an electric current flowing in a coil creates a large magnetic field in a cylindrically shaped gap. The rotor contains appreciable area which rotates within this gap. Motion of the rotor causes periodic magnetization and demagnetization of the rotor material. Each magnetization cycle involves an energy loss, and this loss generates a force resisting the motion of the rotor.

A third type of brake is the particle brake, which combines the features of the hysteresis and friction brakes. Small particles are present in the gap between the rotor and the stator. The resistance is produced by both friction of the particle motion and the repeated reverse magnetization of the particles. Greenhut disclosed in U.S. Pat. No. 4,620,703 a machine that employs a particle brake generating a resistance in both directions of exercise motion. Greenhut also mentioned the response time problem of brakes, and thereby proposed the more efficient particle brake combined with a transmission system having a high gear ratio.

The frictional properties of materials used in friction brakes tend to vary with rotor speed, making the force vs. current characteristic non-ideal. The difference between static and dynamic friction causes an undesirable jerky motion when exercising with a friction-brake-based resistance machine.

Hysteresis brakes tend to have a more constant force vs. velocity relationship, but the absence of material contact causes the hysteresis brake to be less efficient than the friction brake in producing a torque in response to a given input current. The loss of efficiency is regained in using larger coils, but this in turn increases the electrical inertia, or inductance, which is a problem when trying to change electrical current levels (and hence resistance force levels) quickly during the exercise process.

The desire to use smaller, lower cost, electric brakes can be fulfilled by using gear trains in the mechanical coupling of the user's motion to the rotary motion of the brake. The gear train causes the brake's rotor to rotate more quickly, hence magnifying the resistance apparent to the user. The gear train also introduces friction regardless of the type of brake used. Also, the rotary mass of large gears can be particularly noticeable at the start and end of the exercise stroke. At the start of the stroke, the user must exert more to bring the system up to a desired exercise speed. At the end of the stroke, the kinetic energy of the system, and not the user's exertion, keeps the system in motion. Hence, rotary mass interferes with the exercise process.

The problems discussed previously, i.e. those of inductance and rotary mass can be solved through the use of this invention. In addition, this invention can provide exercise modes not previously available from brake-based machines. The prior art brake-based resistance machines available from Paramount provide slowly varying forces, and hence is limited to a single mode of exercise (isotonic). This invention, with the addition of sensors and compensation circuits, further improves over the prior art by making possible brake-based resistance with additional exercise modes, including isokinetic, isometric, and viscous.

Isokinetic and isometric exercise modes are well known. Isokinetic means "constant speed", and isokinetic resistance machines resist the user's motion to the extent necessary (and no further) to maintain a constant speed of motion. In brake-based resistance systems, no resistance is applied until the user reaches the set speed, and is henceforth maintained at that speed. Isometric means "constant position" and isometric machines oppose the user's exerted force such that very little motion is produced. In practical brake-based resistance machines, isometric exercise is equivalent to a very slow isokinetic exercise. A single position cannot be maintained exactly due to the inability of the brake to produce motion. Viscous resistance is not as well known, but is also a desirable exercise mode. In viscous resistance, the resulting force is proportional to the speed of motion. This exercise mode is unique in the smoothness of motion created. Hydraulic cylinders, in which a fluid is pushed through a small hole produces viscous resistance naturally. This invention permits viscous resistance to be simulated accurately using an electric brake.

SUMMARY OF THE INVENTION

This invention relates to an apparatus consisting of an electric circuit that drives an electric current into an electric brake which accomplishes the following functions:

(1) generates braking forces nearly instantaneously in response to electrical command signals and provides a continuously varying resistance vs. position mode of operation during an exercise stroke, (2) permits, with the addition of a compensation circuit, isokinetic, isometric, or viscous mode of resistance, and (3) permits, with the addition of compensation circuits, cancellation of friction, gravitational or inertia forces associated with rotational mass anomalies in the mechanical drive train.

The invention is versatile and capable of any one of the mentioned exercise modes in (1) and (2) simultaneous with the compensations of (3).

The input signal to the circuit of the invention is a low voltage, possibly time varying, signal from a computer or other electronic circuit. The output function is a mechanical resistance force, large enough for meaningful exercise, but at all times closely proportional in magnitude to the voltage of the input signal.

BRIEF DESCRIPTION OF THE DRAWINGS

FIG. 1(*b*) presents the response curve of the resistance force of the machine of FIG. 1(*a*) to a step increase in the desired resistance force signal.

FIG. 1(*c*) presents the response curve of the brake current and collector-emitter transistor voltage Vce to a step decrease in the desired resistance force signal.

DETAILED DESCRIPTION OF THE PREFERRED EMBODIMENT

Figure 1A:
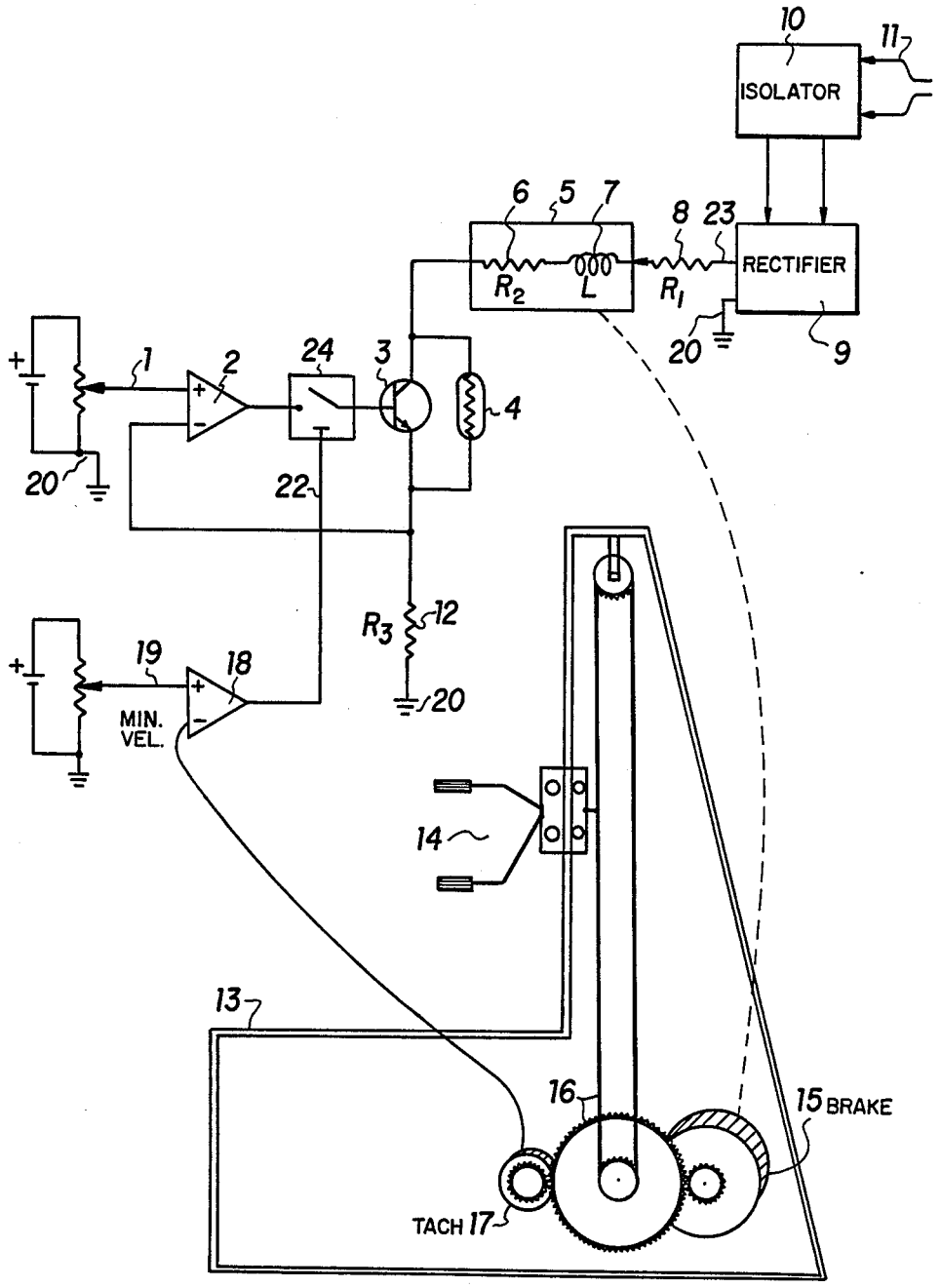
FIG. 1(*a*) is a schematic diagram of a circuit controlling an exercise machine that embodies the invention.
Figure 1B:
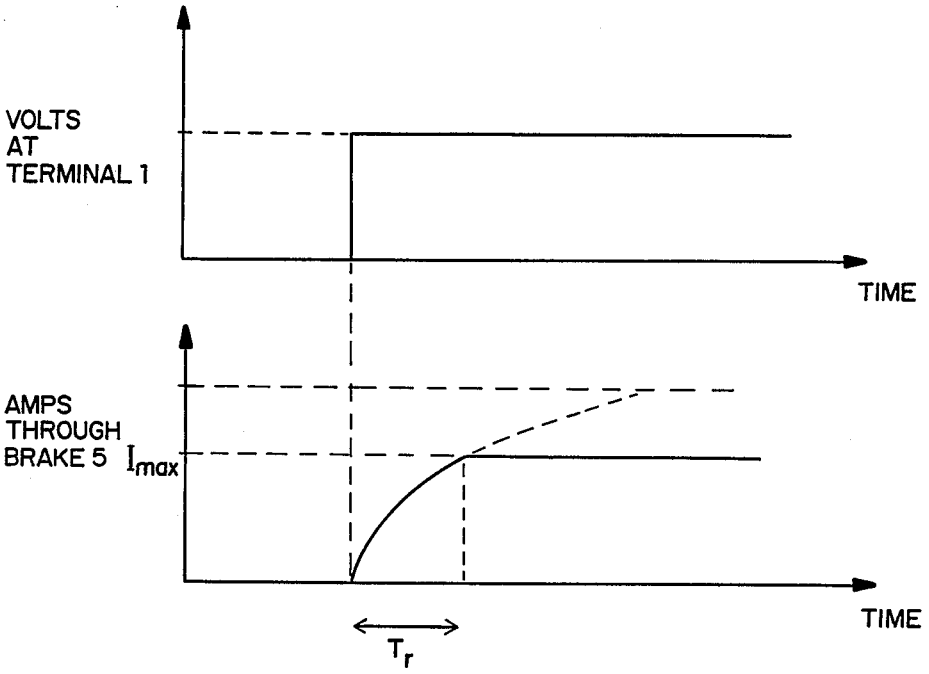
Figure 1C:
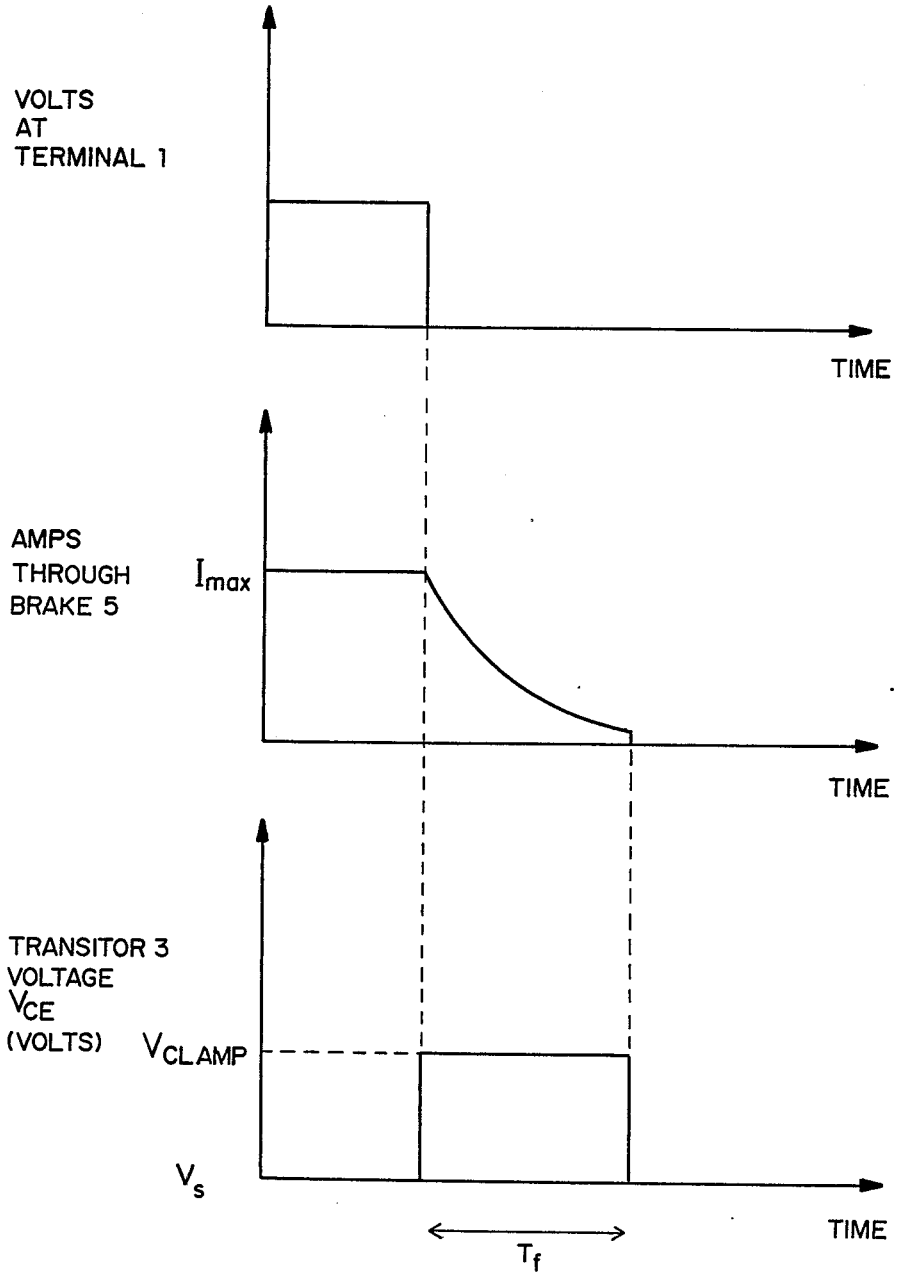

Refering to FIG. 1(*a*), there is shown an exercise machine having a mechanism 14 to engage and move under the force of a user's moving member. The user's motion is coupled to the rotor of an electrically activated brake 15 through a mechanical transmission system 16. Brake 15 provides a resistance torque to its rotor when an electrical current is flowing in the stationary coil. The rotational motion of the brake rotor is also coupled to a velocity sensor or tachometer 17 by transmission 16. The entire mechanical system is supported by a frame 13 to provide structural stability. The brake 15 is activated electrically by means of current flowing through a coil 5 shown schematically as resistor 6 (having a value R2) and an inductor 7 (having a value L).

An input voltage signal representative of the desired torque from a variable voltage source is provided at terminal 1. The variable voltage source could be a potentiometer producing a voltage level that varies between two limits, or it could be a digital computer capable of generating an analog voltage through a digital-to-analog converter. The voltage level from the voltage source is applied to terminal 1 of a high gain difference amplifier 2, which amplifies the magnitude of the voltage relative to a sensed voltage relative to ground across current-sensing resistor 12. The output signal of the difference amplifier 2 is switched to the base of transistor 3 by means of switch 21 in response to the output signal of the tachometer 17. When the velocity sensor 17 produces a signal having a voltage level that is greater than a set minimum level voltage signal applied to input terminal 19 of comparator 18, a logical one voltage signal is applied to line 22 which closes switch 21. Otherwise switch 21 remains open.

When the speed of the user's motion exceeds the speed represented by the velocity signal on terminal 19, difference amplifier 2 is able to energize a transistor 3, which is a current amplifier. Transistor 3 could be a bipolar transistor as shown, or it could be a Mosfet transistor with gate, source, drain connected the same way as the base, collector, emitter, respectively, of the bipolar transistor. A silicon controlled rectifier (SCR) could also be used in place of bipolar transistor 3 with the gate, anode, cathode connected the same way as the base, collector, emitter, respectively. For proper operation with an SCR, the power supply voltage applied to the anode must dip below the SCR's turn-off voltage periodically at a fast rate.

The degree to which transistor 3 is energized is controlled by the magnitude of the difference between the signals on the non-inverting and inverting input terminals of amplifier 2, i.e. the difference between the desired level of resistance force and the resistance force provided by the brake.

Difference amplifier 2 is selected to have a high gain such that servo action causes the voltage signal representative of the brake current sensed by resistor 12 to stabilize quickly to the voltage level on terminal 1. The end result is that the resistance force generated by the brake follows the desired resistance force represented on the input terminal 1. The servo action is explained in more detail below.

The current flowing in the coil 5 and in resistor 12 is produced by a voltage difference existing between a DC voltage on line 23 and ground 20. This DC voltage is derived from an available AC voltage source 11 that is isolated from the remainder of the circuit of the present invention by an isolation transformer 10, and then rectified by a rectifier 9. Resistor 8 (having value R1) is inserted between rectifier 9 and coil 5 to limit the maximum current flow possible in the coil 5 to a safe level. A voltage clamping device 4 is connected between the emitter and collector of transistor 3. Device 4 has a very low electrical resistance when voltage across it exceeds a particular "clamping" voltage level, otherwise it has a high serial resistance. Metal oxide varistors and zener diodes exhibit this variable resistance characteristic, and either could be used as the clamping device. The clamping device 4 protects the transistor 3 from unusually high voltages that occur in circuits with a large inductance, e.g. coil 5 having inductive component 7 (L).

Resistor 12 is used to sense the current flowing in the brake during exercise motion. This current is related to the torque being exerted by the user, and hence resistor 12 voltage is a measure of the exerted torque. The exerted torque can also be measured, or sensed, by a pressure transducer mounted somewhere in the mechanical coupling of the user's force. The output of the pressure transducer is a voltage proportional to the user's force, which can be substituted for the voltage across resistor 12. Also, a strain guage could sense the user's torque if mounted on a portion of the mechanical system that is strained by the user's force. A strain guage produces a voltage proportional to the user's torque, which can be substituted for the voltage across resistor 12.

The important characteristic of the circuit diagrammed in FIG. 1(*a*) is its fast response time, which can be quantified in two parts: the rise time and the fall time. The rise time, Tr, is the elapsed time needed for the brake current to reach its maximum value Imax. When current Imax is flowing in the coil 5, the maximum resistance force is available from the brake. The fall time Tf is the elapsed time required for the current in the brake to drop to zero from Imax. The rise time and fall time are ideally much shorter than a typical exercise stroke, so that varying resistance levels are possible within the stroke. A typical exercise stroke lasts about 1 to 2 seconds.

FIG. 1(*b*) shows a very demanding input voltage (applied as a voltage level at terminal 1 in FIG. 1(*a*) from the exercise control system, namely to increase the brake current from zero to its maximum value. The time required to generate this current is the rise time Tr which will now be computed. FIG. 1(*b*) shows the current waveform in response to the step input voltage signal. This curve begins with an exponential rise with an exponential time constant of z=L/R, where L is the value of the inductor 7 of the brake coil 5 and R=R1+R2+R3, the total resistance in the path from the supply voltage to ground. When the maximum current, Imax, is reached, the exponential behavior ceases, and the amplifier 2 components and feedback work only to maintain the current at the level of Imax. The rise time, Tr, and maximum current, Imax, are related by the following equation:

$$Vs/R\,[1-e^{-Tr/z}]=I_{max} \tag{1}$$

where z=L/R. Tr can be calculated by rearrangement of equation (1) as follows:

$$T_r=-L/R\,\log[1-I_{max}R/Vs] \tag{2}$$

A rise time Tr of 0.083 seconds was achieved in our prototype apparatus in which Imax=0.6 amps corresponded to 200 lbs or equivalent force resistance. In this system L=11 henries, R=R1+R2 +R3=100+22+5 ohms, respectively and Vs=120 volts of rectified household electricity. Hence, the brake current could increase from zero to 0.6 amps in 0.083 seconds, and hence the corresponding resistance force could increase from zero to 200 lbs in the same time duration, and this was demonstrated to be sufficient for high-quality force resistance control in a vareity of exercise modes.

Another very demanding input voltage is illustrated in FIG. 1(*c*) as a step decrease from its maximum value to zero. The fall time, Tf, is the time required for the force resistance to reach zero, or equivalently when current through coil 5 ceases to flow. It is assumed that the input signal on terminal 1 remains at the maximum value for a long time prior to t=0, and that the maximum resistance force had been reached. The current through coil 5 ceases to flow when all energy stored in the magnetic field of inductor 7 coil is dissipated. The fall time is to be calculated by indicating the time required to dissipate all energy stored in the brake. Transistor 3 in FIG. 1(*a*) will not dissipate an appreciable amount of energy because no current flows from its collector to emitter when the voltage on the base is low. The components that dissipate energy are resistors 8, 6, and 12 and voltage clamping device 4.

When the input voltage level on termnal 1 drops to zero, transistor 3 turns off and no current flows from its collector to emitter, attempting to halt the current flow. However, because the voltage across the inductive portion 7 of the brake coil 5 is proportional to the derivative of the current, the brake voltage will become negative very rapidly. The voltage clamping device 4 will allow current to flow between its terminals when the voltage across it reaches its clamping voltage Vclamp. Furthermore, the clamping device 4 will continue to let current flow through it until the voltage across it decreases to a level less than Vclamp. While voltage level Vclamp is maintained by the clamping device, the brake current will decay exponentially as shown in FIG. 1(*c*).

The power dissipated in clamping device 4 is the maintained voltage, Vclamp, multiplied by brake current I(t). Resistors 8, 6, and 12 will dissipate power equivalent to RI(t), where R=R1+R2+R3. The integral value of the total power dissipated over time should be equal to the energy stored in the brake coil inductor 7 prior to time zero, and this energy value is (½) L Imax. Hence, the fall time can be calculated from the expression $$\int_0^{Tf}[V_{Clamp}i(t)+Ri^2(t)]dt=\tfrac{1}{2}LI_{max}^2 \tag{3}$$

Rearranging the equation $$\int_0^{Tf} i(t)[V_{Clamp}+i(t)R]dt=\tfrac{1}{2}LI_{max}^2 \tag{4}$$

A simplifying approximation can be made if Vclamp is assumed to be much greater than i(t) R for most of the time. This approximation is valid for our apparatus. Substitute i(t)=Imax (1−exp(−t/z) where z=L/R and exp() is the natural exponential function. Making the approximation gives $$\int_0^{Tf} I_{max}(1-e^{-t/z})V_{Clamp}dt=\tfrac{1}{2}LI_{max}^2 \tag{5}$$

or equivalently $$V_{clamp}\,[T_f+Z(e^{-Tf/z}-I)]=\tfrac{1}{2}L\,I_{max} \tag{6}$$

where Tf can be found through numerical iteration. For our prototype apparatus Vclamp=360 volts, z=L/R=0.0866 seconds, L=11 henries, and Imax=0.6 amps. Under these conditions Tf=0.045 seconds, calculated from equation (6).

The rise time of 0.083 seconds and the fall time of 0.045 seconds are much shorter than the duration of a typical exercise stroke which is typically 1–2 seconds. Hence, our apparatus is capable of a wide variety of exercise modes, and indeed has been so demonstrated.

The importance of high voltage circuitry is critical in achieving these fast rise and fall times. The rise time is heavily dependent on the power supply voltage level being much larger than would ordinarily be required to generate Imax in steady state. In fact, for our apparatus, only 12 volts is needed to achieve Imax in steady state, but 120 volts is needed for a satisfactory response time.

The fall time is heavily dependent on the clamping voltage being large in value as indicated by equation (6). Because the rate of energy dissipation of the clamping device 4 is proportional to the clamping voltage, the brake current can be brought to zero quickly when the clamping voltage is high.

Normally high voltage components increase the cost of a circuit significantly. In our design, the high voltage power supply in FIG. 1(*a*) is simply an isolation transformer 10, i.e. a transformer with a one-to-one voltage ratio, and a rectifier 9 coupled to the power already available from the utility company. This power supply does not require regulation, and the absence of regulation lowers the cost normally incurred by high voltage power supplies. Because the brake has such a large inductance, its presence in the circuit serves to filter the power supply voltage in the circuit of FIG. 1(*a*), although some "ripple" in the brake current is produced. However, this ripple is of too high a frequency (50 to 60 cycles per second) to be noticed by the user. Also, since a brake does not produce motion, no vibrations are created by the presence of the ripple. This represents an economic advantage of brake-based exercise machines based on this invention over prior-art motor-based machines. A motor-based machine would almost certainly require a tightly regulated power supply to reduce ripple-induced vibrations to an acceptable level.

Therefore, the combination of all features designed into our apparatus makes possible a low-cost brake-based exercise machine that is capable of high performance through fast response.

FIGS. 2 through 7 show additional embodiments of the invention with the force driver 25 representing the circuit of FIG. 1(*a*). In FIGS. 2 through 7, single line connections indicate electrical connections and line pairs indicate mechanical linkages.

Figure 2:
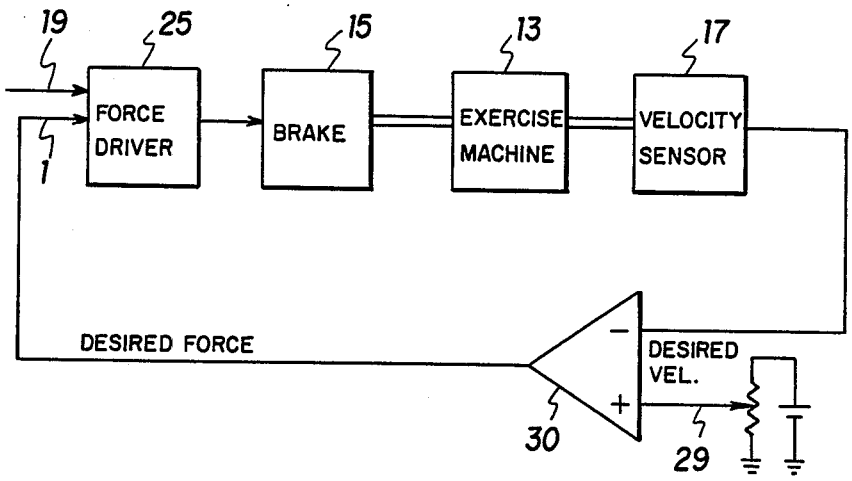
FIG. 2 is a block diagram showing the invention being used to create isokinetic resistance.

FIG. 2 shows the use of the circuit of FIG. 1(*a*) to achieve isokinetic resistance. The force driver circuit 25 provides a current to electric brake 15, the rotor of which is mechanically coupled to the exercise machine 13. A velocity sensor 17 coupled to the exercise machine 13 converts the mechanical speed of the user's motion into a proportional electric voltage. This voltage is subtracted from a desired set point voltage on terminal 29 of a high gain difference amplifier 30. Amplifier 30 is used as a feedback compensator to increase current flow to the brake by means of the force driver 25 when the user's speed, as measured by the voltage produced by the velocity sensor 17, is greater than the desired set point voltage on terminal 29.

FIG. 2 also shows how the circuit of FIG. 1(*a*) may be used to achieve isometric resistance. It is functionally equivalent to the isokinetic system, except that the desired velocity signal on terminal 29 is set to zero.

Figure 3:
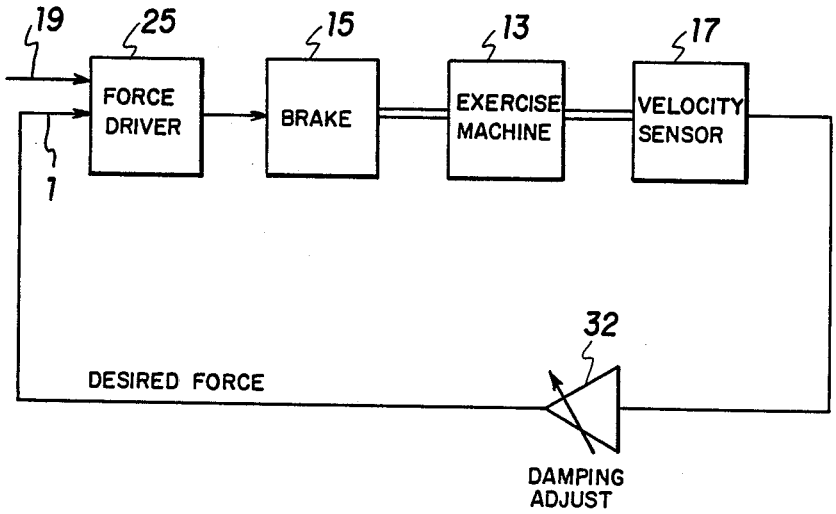
FIG. 3 is a block diagram showing the invention being used to create viscous resistance.

FIG. 3 shows how the circuit of FIG. 1(*a*) may be used to achieve viscous fluid type resistance. In this system, the top row of elements are the same and interconnected in the same way as in FIG. 2 with the signal representative of the desired force set proportional to the user's speed. The user's speed is sensed by the velocity sensor 17. The constant of proportionality (the viscous damping coefficient) is adjustable through the use of a gain stage 32. A digital computer could also accept the signal from the velocity sensor by means of an analog-to-digital converter and could output the proportional voltage level to terminal 1 by means of a digital-to-analog converter.

Figure 4:
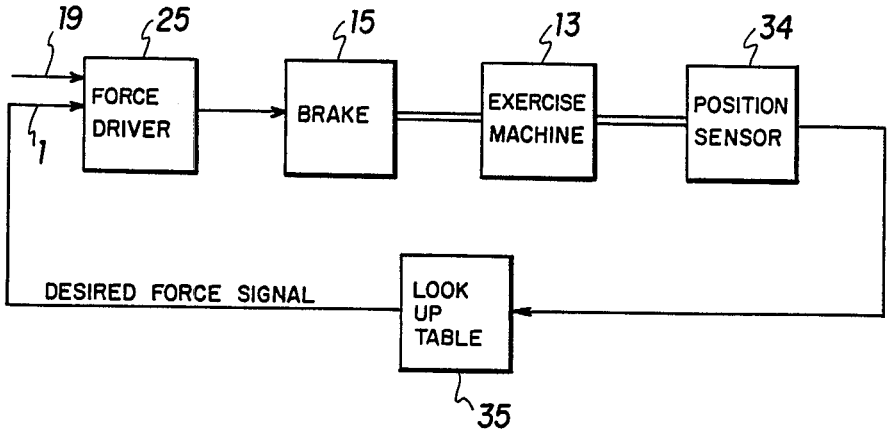
FIG. 4 is a block diagram showing the invention being used to vary the resistance level as an explicit function of the position of the user's moving member.

FIG. 4 shows how the circuit of FIG. 1(*a*) may be used to achieve a desired force vs. position profile, or variable resistance. In this exercise system, the top row of elements are again as those in FIG. 2 with a position sensor 34 in place of the velocity sensor 17. The position sensor 34 senses the position of the user's moving member by providing a voltage signal representative thereof. For example, a potentiometer with a fixed voltage across the two outer electrotrodes will produce such a signal on the third electrode if its shaft is coupled to the rotor of brake 15. The voltage signal from the position sensor 34 is applied to a look-up table 35 to determine the desired level of resistance force for each sensed position. The look up table could represent a resistance vs. position profile recommended by a coach, therapist, or the user. It could also be defined by a digital computer that can read the output of the position sensor and provide a corresponding voltage level to terminal 1.

Figure 5:
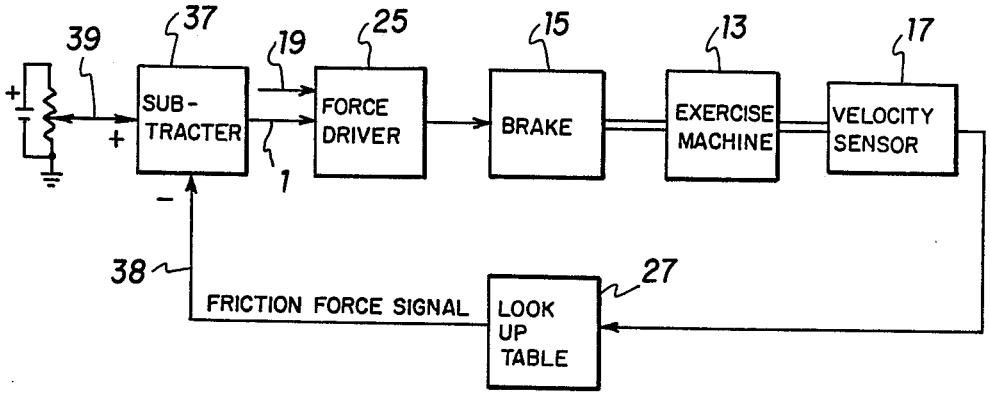
FIG. 5 is a block diagram showing the invention being used to cancel the unwanted but known effects of friction, whose forces are a known function of velocity.

FIG. 5 shows how the circuit of FIG. 1(*a*) may be used to cancel the unwanted, but known, effects of friction. In this embodiment, the top row of elements is as shown in FIG. 2 with a subtracter 37 added preceeding force driver 25. The velocity sensor 17 senses the velocity of the user's motion, and the look up table 27 is used to determine the level of frictional force represented by the signal on line 38 known to be generated by the mechanical system at each level of velocity. This estimate is subtracted from the desired force (represented by the input voltage on terminal 39 of subtracter 37) by the voltage subtracter 37. The force driver 25 thereby generates a force which equals the desired force minus the frictional force. The frictional force in the mechanical system is therefore cancelled. A digital computer could also accept the signal from the acceleration sensor and output the proper signal to terminal 1 and achieve the same result.

Because the brake can only resist motion, the desired force level must be greater than or equal to the frictional force at all times for true cancellation to occur. The desired force level represented by voltage on terminal 39 could be identical to the force level specified in FIG. 2, 3, or 4, depending on which exercise mode is desired.

Figure 6:
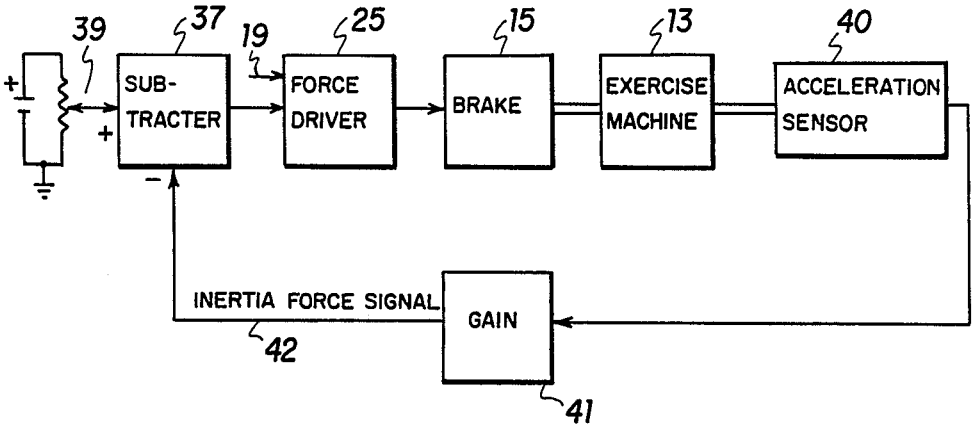
FIG. 6 is a block diagram showing the invention being used to cancel the unwanted problems of rotary mass typical of transmissions with large gear ratios.

FIG. 6 shows how the circuit of FIG. 1(*a*) may be used to cancel the unwanted forces generated by the rotary mass of the drive train 16 and other mechanical components. The top row in this FIG. is as in FIG. 5 with an acceleration sensor 40 replacing the velocity sensor 17. The force generated by the rotary mass of the drive train is proportional to the rotary acceleration. The rotary acceleration is sensed by acceleration sensor 40 and a gain stage 41 amplifies the signal therefrom such that the inertia force signal on line 42 represents the force due to rotary acceleration. Cancellation is achieved by voltage subtracter 37. A signal representative of the desired force level (terminal 39) in this system could be identical to the force level specified in FIGS. 2, 3, or 4 depending on which exercise mode is desired. Again, a digital computer could accept the signal from the acceleration sensor and output the proper voltage to terminal 1. Because the brake can only resist motion, the desired force level must be greater than or equal to the force generated by the rotary mass at all times for true cancellation to occur.

Figure 7:
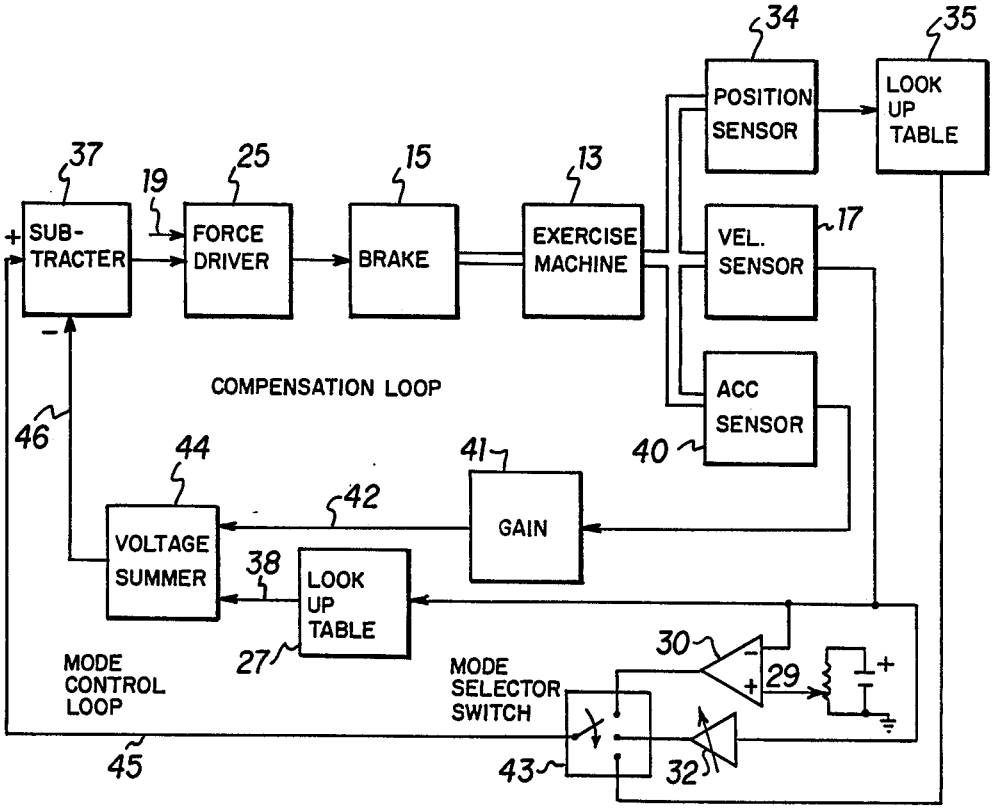
FIG. 7 is a block diagram showing the invention being used to cancel friction and rotary inertia, and switch selectable modes for isotonic, isokinetic, and isometric resistance.

FIG. 7 shows how the circuit of FIG. 1(*a*) may be used to simultaneously cancel inertia and friction with the exercise mode selectable as isokinetic, viscous, or resistance vs. position. Subtractor 37, force driver 25, brake 15, and exercise machine 13 are the same and are interconnected in the same way as in FIGS. 5 and 6. The sensors 34, 17, and 40 are now simultaneously coupled to exercise machine 13, rather than individually. Gain stage 41 produces a signal representative of the rotary inertia in the same way as in FIG. 6. Look-up table 27 produces a signal representative of the frictional forces in the same way as FIG. 5. Voltage summer 44 produces a signal representative of the total force to be canceled from the desired force by subtractor 37. When the mode selector switch 43 is in the top, middle, or bottom position, the desired force is equal to the force necessary for isokinetic resistance, viscous resistance, or resistance vs. position, respectively. These signals generate the desired force level in the same way as FIGS. 2, 3, and 4 when the switch is in the top, middle, or bottom position, respectively. A digital computer could perform many of the functions illustrated in FIG. 7 by accepting the signals from the sensors and providing the proper voltage level at terminal 1.

All of the exercise modes outlined (isokinetic, isometric, viscous, and force vs. position) and the compensations (for friction and inertia) perform well only when the machine generating the resistance force has a fast response time.

In isokinetic exercise, the machine must resist the user's varying exertion precisely to achieve a truly constant speed of motion. If the speed is maintained precisely, then the user's exertion level is represented accurately by the current flowing in the brake at all times. This current can be sensed easily by a computer or other monitoring device (e.g. by means of an analog-to-digital converter) to record an accurate measure of the user's exertion force at every position. If the user is exerting to his maximum potential, then the sensed current flowing in the brake measures the user's strength, and this information is valuable to athletic strength trainers or physical therapists analyzing an injury. Without the fast response time, the velocity would vary during the measurement. These variations in velocity represent acceleration and deceleration, making it impossible to separate the user's exertion force and the forces generated by the acceleration/deceleration. Hence, a fast response time is required to accurately sense the user's exertion during isokinetic exercise.

In the viscous resistance mode, the desired level of resistance is proportional to speed. Because the speed can vary quickly at the discretion of the user, a fast response time is required to produce a truly viscous resistance characteristic. The truely viscous nature of the resistance leads to a smoother and often more pleasant exercise.

In the force vs. position exercise mode, a fast response is required if the resistance force generated is to follow the desired force vs. position profile. This profile can be generated intelligently by a computer as outlined in the U.S. Pat. No. 4,354,676 by Gideon Ariel.

The strong dependence of frictional forces on speed again leads to a fast response requirement to achieve adequate cancellation. The strong dependence of inertia-related forces on acceleration lead to the same requirement for cancellation.

What is claimed is:

1. A machine including a resistance control system for use by an individual comprising:

first means disposed for engagement by at least one limb of said individual;

electric brake of one of the hysteresis and friction types having a rotor and stator, said brake generates a resistance torque to rotary motion of the rotor proportional to an electrical current flowing in the stator;

second means for converting motion imparted to the first means by said individual to cause a rotary motion of the rotor of the brake;

third means disposed for receiving a signal proportional to the desired resistance torque of the brake to oppose the motion of the individual;

fourth means for measuring the torque exerted by the individual;

fifth means for increasing the stator current when the desired torque exceeds the measured torque exerted by the individual by applying a voltage to the stator of the brake that is greater than the voltage necessary to maintain the measured torque in the steady state; and sixth means for removing inductive energy from the stator when the measured torque exerted by the individual exceeds the desired torque by maintaining a reverse voltage thereacross that is greater than the voltage necessary to achieve the measured torque in the steady state.

2. The machine of claim 1 wherein the third means includes a potentiometer creating a variable voltage level between two limits.

3. The machine of claim 1 wherein the third means includes a digital computer capable of generating an analog signal.

4. The machine of claim 1 wherein the fourth means is a voltage level across a resistor connected in series with the coil of the brake.

5. The machine of claim 1 wherein the fourth means is a pressure transducer.

6. The machine of claim 1 wherein the fourth means is a strain guage.

7. The machine of claim 1 wherein the electric brake generates a resistance torque through hysteresis loss within a rotor material repeatedly being reverse magnetized by motion within a magnetic field created by the current flowing in the stator.

8. The machine of claim 1 wherein the electric brake generates a resistance torque through friction of the rotor and stator brought together by the force generated by the magnetic field created by the current flow in the stator.

9. The machine of claim 1 wherein the electric brake generates a resistance torque through motion of magnetic particles located between the rotor and the stator.

10. The machine of claim 1 which further includes seventh means disposed to receive and rectify an AC voltage signal for purposes of supplying power.

11. The machine of claim 1 further includes eighth means disposed to receive direct current from a direct current power supply.

12. The machine of claim 1 wherein the fifth means includes:

difference means for generating a difference signal proportional to the difference between the signals representative of the desired and measured torque values; and bipolar transistor means disposed to have said difference signal applied to base thereof.

13. The machine of claim 1 wherein the fifth means includes:

difference means for generating a difference signal proportional to the difference between the signals representative of the desired and measured torque values; and Mosfet transistor means disposed to have said difference signal applied to gate thereof.

14. The machine of claim 1 wherein the fifth means includes:

difference means for generating a difference signal proportional to the difference between the signals representative of the desired and measured torque values; and silicon-controlled rectifier means disposed to have said difference signal applied to gate thereof and a rectified AC voltage applied to anode thereof.

15. The machine of claim 1 wherein the sixth means includes a zener diode connected in parallel with the stator.

16. The machine of claim 1 wherein the sixth means includes a metal oxide varistor connected in parallel with the stator.

17. The machine of claim 1, further includes:

eighth means for sensing the position of the point of engagement of said at least one limb of the individual; and ninth means coupled to the eighth means for making the desired torque a function of the sensed position.

18. The machine of claim 17 wherein the ninth means includes a look-up table.

19. The machine of claim 17 wherein the ninth means includes digital computer capable of reading and generating analog signals.

20. The machine of claim 1 further includes:

tenth means for sensing the speed of the user's motion; and eleventh means coupled to the tenth means for generating the desired torque as a function of the sensed speed.

21. The machine of claim 20 wherein the eleventh means includes a high gain difference amplifier amplifying the difference between the signals representative of the sensed speed and desired speed such that the desired speed is rarely or insignificantly exceeded.

22. The machine of claim 20 wherein the eleventh means includes an amplifier with a gain value such that a desired proportionality is realized between the torque and speed of motion.

23. The machine of claim 20 wherein the eleventh means includes a look-up table such that the desired torque is adjusted to cancel the torque produced by friction in the moving mechanism.

24. The machine of claim 20 wherein the eleventh means includes a digital computer capable of generating and accepting analog signals.

25. The machine of claim 1 further includes:

twelth means for sensing the acceleration of the user's motion; and thirteenth means coupled to the twelth means generating the desired torque as a function of the sensed acceleration.

26. The machine of claim 25 wherein the thirteenth means includes a gain stage such that the desired torque is adjusted for inertia of the moving parts of the machine.

27. The machine of claim 25 wherein the thirteenth means includes a digital computer capable of generating and accepting analog signals.

* * * * *